United States Patent [19]

Maki et al.

[11] 4,393,820

[45] Jul. 19, 1983

[54] ROLLING CONTACT ROCKER ARM AND PIVOT

[75] Inventors: Emil R. Maki, Rochester, Mich.; Ferdinand Freudenstein, Riverdale, N.Y.; Raymond L. Richard, Jr., Port Clinton, Ohio; Meng-Sang Chew, Sterling Heights, Mich.

[73] Assignee: General Motors Corporation, Detroit, Mich.

[21] Appl. No.: 356,926

[22] Filed: Mar. 10, 1982

Related U.S. Application Data

[63] Continuation-in-part of Ser. No. 261,736, May 7, 1981, abandoned.

[51] Int. Cl.[3] ..... F01L 1/18

[52] U.S. Cl. ..... 123/90.41

[58] Field of Search ..... 123/90.39, 90.41

[56] References Cited

U.S. PATENT DOCUMENTS

| | | | |
|---|---|---|---|
| 1,497,451 | 6/1924 | Kytlica | 123/90.41 X |
| 2,943,612 | 7/1960 | Middler | 123/90.41 |
| 3,198,183 | 8/1965 | Ball | 123/90.42 |
| 3,621,823 | 11/1971 | Lombardi | 123/90.42 |
| 4,314,732 | 2/1982 | Murphy | 123/90.41 X |

*Primary Examiner*—William A. Cuchlinski, Jr.

*Attorney, Agent, or Firm*—Arthur N. Krein

[57] ABSTRACT

In an engine valve train, each rocker arm and its associate fulcrum are provided with cooperating inner and outer cylindrical surface contours carrying the reaction forces of rocker arm, the ratio of the radius of the outer surface contour being approximately in the order of 3:1 to 1.7:1 and preferably 2:1, the rocker arm and fulcrum having a cooperating retainer recess and pin, intermediate the ends of the associate bearing surface, to maintain alignment of these elements in substantially rolling contact with each other during pivotable movement of the rocker arm. In the preferred embodiment the radii of curvature of these bearing surfaces are selected in the ratio of 2:1 so as to obtain rolling motion known as cardanic motion, the recess being defined by opposed inclined flat surfaces and, the working surfaces of the pin being of semi-circular profile in substantial two-point contact with the surface defined by the recess.

9 Claims, 11 Drawing Figures

ROLLING CONTACT ROCKER ARM AND PIVOT

FIELD OF THE INVENTION

This application is a continuation-in-part of copending application Ser. No. 261,736 filed May 7, 1981, now abandoned and assigned to the same assignee.

This invention relates to valve trains for internal combustion engines and, in particular, to a rocker arm and pivot assembly for use in such valve trains.

DESCRIPTION OF THE PRIOR ART

Conventional rocker arm and pivot assemblies, as normally used in passenger vehicle type engine valve trains, for example, as used in an overhead valve push-rod type actuated valve train, include a pedestal mounted rocker arm which generally has a spherical or part cylindrical pivot or fulcrum that provide essentially large bearing surfaces. With such an arrangement, the rocker arm is actually in sliding engagement relative to its associate fulcrum and, thus even though these elements may be adequately lubricated, this type arrangement still provides a large area for frictional resistance so as to produce a heat build-up as a result of the loads being applied to the respective bearing surfaces.

The desirability to overcome the above problem has been recognized and, accordingly, various specially constructed or non-production, in terms of passenger vehicle usage, type rocker arm assemblies have been proposed. Such specially constructed or non-production type rocker arm assemblies have been used in special engine applications, as for example, in engines of race cars. Thus in such specialized engine applications, in order to reduce friction, roller bearing assemblies have been used to pivotally support a rocker arm. Such roller bearing assemblies are mounted, for example, on stub shafts secured to a fulcrum in a manner whereby to pivotably support an associate rocker arm in a manner similar to that shown, for example, in U.S. Pat. No. 3,621,823 entitled Frictionless Rocker Arm Fulcrum Assembly, issued Nov. 23, 1971 to John Lombardi.

It is readily apparent that such a rocker arm and its associate pivot assembly which includes one or more roller bearing assemblies is far more complex and expensive, from a production standpoint, to use in conventional passenger vehicle engines.

It has also been proposed to provide a rocker arm and pivot arrangement such that the rocker arm is claimed to be movable about a support in rolling motion in a manner shown, for example, in U.S. Pat. No. 2,943,612 entitled Valve Gear which issued on July 5, 1960 to Alexander G. Middler as an improvement over the rocker arm pivot structure shown in U.S. Pat. No. 1,497,451 entitled Rocker Arm issued June 10, 1924 to John F. Kytlica.

It will be apparent that the rolling contact between the rocker arm and pivot of this U.S. Pat. No. 2,943,612 patent teaching is comparable to that of a cylinder rolling on a flat or substantially flat surface. It is well known from standard engineering texts that a cylinder rolling on a flat surface creates a high operating contact stress. Thus the result of using a cylinder rolling on a flat or substantially flat surface, as in the rocker arm and pivot structure of the U.S. Pat. No. 2,943,612, would be to require the use of heavier gage material, and perhaps more expensive material in such a rocker arm arrangement to reduce the tendency to early fatigue failure due to the high stresses encountered during engine operation. As will be apparent, such increased mass of the rocker arm in this regard would be detrimental to smooth valve train operation because increased inertia forces can cause degradation of the valve train performance.

SUMMARY OF THE INVENTION

A primary object of the present invention is to provide an improved rocker arm and pivot assembly wherein an otherwise conventional type rocker arm and its fixed fulcrum are provided with part circular concave and convex bearing surfaces having preferably a radius relationship of substantially R and one-half R, respectively, with these elements being provided with a retainer pin and slot arrangement whereby there is effected a substantially rolling or walking contact between all parts relative to each other during pivotable movement of the rocker arm.

Accordingly, another object of this invention is to provide an improved rocker arm and pivot assembly having a rocker arm with a semi-cylindrical bearing surface intermediate its ends and its associate pivot having a semi-cylindrical fulcrum bearing surface, the ratio of the radii of this surface being on the order of 3:1 to 1.7:1 and preferably 2:1. One of the bearing surfaces is provided with a guide recess or slot therein of a size and shape so as to receive in substantially rolling or walking contact a raised retainer pin provided on the other bearing surface, the slot and retainer pin preferably being located intermediate the arcuate ends of the respective bearing surface.

Still another object of this invention is to provide an improved rocker arm and pivot assembly for use in the valve trains of internal combustion engines which, in operation, is characterized by minimum energy loss to thus maximize fuel efficiency.

Still another object of the present invention is to provide a rocker arm and pivot of the above type which is easy and inexpensive to manufacture, which is reliable in operation, and in other respects suitable for use on production motor vehicle engines.

For a better understanding of the invention, as well as other objects and further features thereof, reference is had to the following detailed description to be read in connection with the accompanying drawings.

DESCRIPTION OF THE PREFERRED EMBODIMENT

Figure 1:
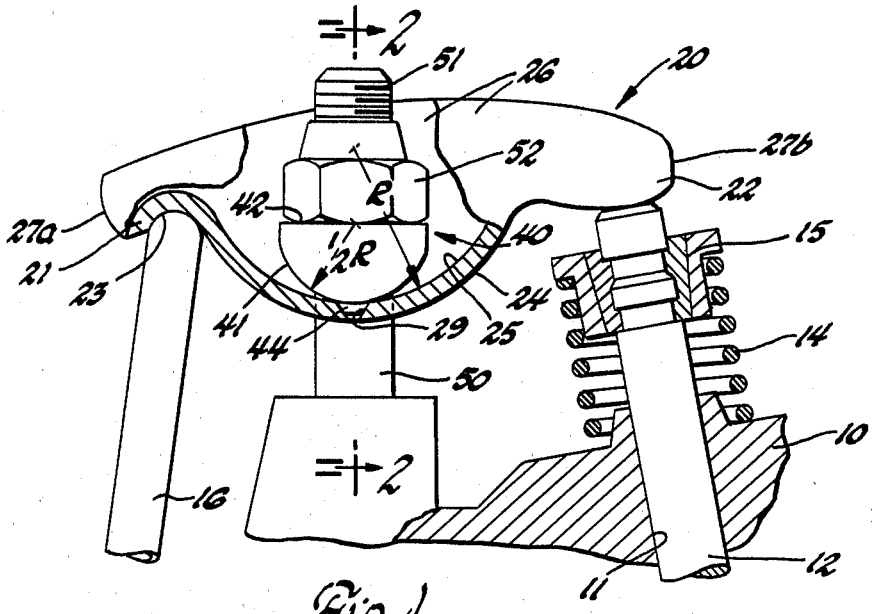
FIG. 1 is a cross-sectional view of a portion of an internal combustion engine having a valve train with a rocker arm and fulcrum in accordance with a first embodiment of the invention incorporated therein, the rocker arm being shown in its mean rocker position and with parts thereof broken away to show details of its bearing surface.
Figure 2:
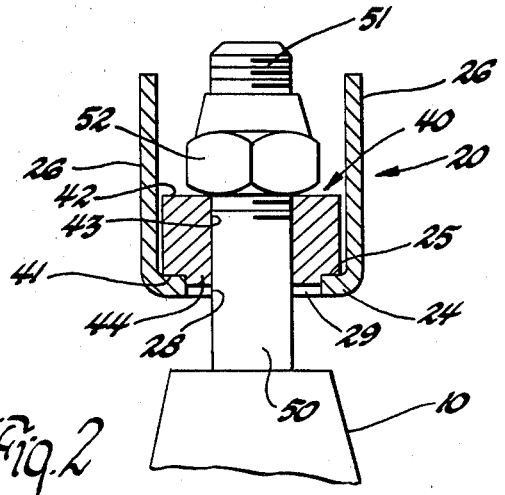
FIG. 2 is a longitudinal cross-sectional view of the rocker arm and fulcrum of the assembly of FIG. 1, taken along line 2—2 of FIG. 1.
Figure 3:
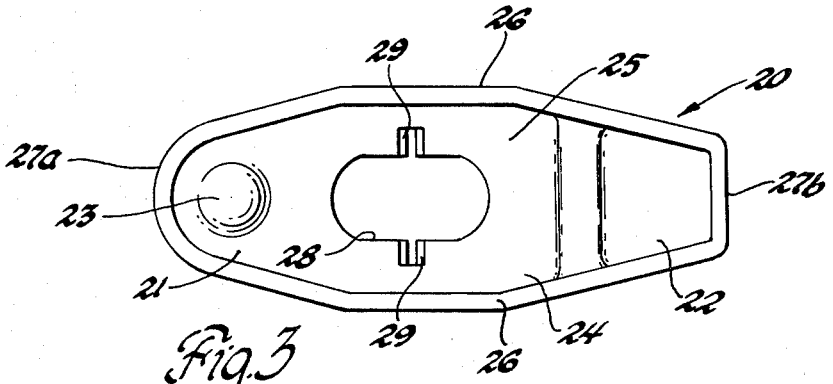
FIG. 3 is a top view of the rocker arm, per se, of the assembly of FIG. 1.

Referring now first to FIGS. 1, 2 and 3, there is shown in FIG. 1 a portion of an internal combustion engine, of the conventional overhead valve type, having a cylinder head 10. Slidably guided for axial reciprocation in the guide bore 11 of the cylinder head 10 is the stem of a poppet valve 12, the upper portion of which projects above the cylinder head. In a conventional manner, the poppet valve 12 is normally maintained in a closed position by a spring 14 encircling the upper portion of the stem of the valve 12, with one end of the spring 14 engaging the cylinder head 10 and the other end engaging a conventional retaining washer assembly 15 secured to the stem of the poppet valve 12 in a conventional manner.

A push rod 16, which is reciprocably disposed in the cylinder head laterally of the poppet valve 12, has its upper end projecting above the cylinder head 10. As would be conventional, the lower end of the push rod 16 abuts against the upper end of a valve tappet, not shown, which operatively engages the cam of a camshaft, not shown, in a conventional manner whereby the push rod is caused to reciprocate, as determined by the profile of the cam on the camshaft, not shown.

Operatively connecting the push rod 16 and the poppet valve 12 is a valve rocker arm, generally designated 20, constructed in accordance with the invention. The rocker arm 20, formed for example of sheet metal, is provided with arms 21 and 22 overlying and resting on the upper ends of the push rod 16 and poppet valve 12, respectively. As shown, the arm 21, on its bottom surface is spherically dished as to 23 to socketably receive the upper end of the push rod 16. Between the arms 21 and 22, the rocker arm is provided with an intermediate curved portion 24 provided with an upper, semi-cylindrical, concave bearing surface 25. As shown in the Figures, the rocker arm 20 is substantially U-shaped in section with a web portion formed by the arms 21 and 22 and the intermediate portion 24, and it is provided with integral upstanding side walls 26 and end walls 27*a* and 27*b*.

The bearing surface 25 is adapted to cooperate in a manner to be described hereinafter with a fixed apertured pivot support or fulcrum 40 having a lower semi-cylindrical concave bearing surface 41 to be described in detail hereinafter.

The rocker arm 20, intermediate its ends and centrally of its intermediate portion 24, is provided with a longitudinally extending aperture 28, as best seen in FIG. 3, through which there extends a suitable support member, here shown as stud 50, that is suitably secured to the cylindrical head 10 and which is provided at its free upper end with external threads 51 to threadingly receive a threaded nut 52 used to retain the fulcrum 40.

As best seen in FIG. 2, the fulcrum 40 in the embodiment illustrated, is of rectangular configuration and is of longitudinal extent whereby it can be loosely received between the side walls 26 of the rocker arm 20. As shown, the fulcrum 40 is provided with a flat upper surface 42 for abutment against the underside of nut 52 and it is provided with a central through aperture 43 of a suitable diameter whereby to slidably receive the stud 50 therethrough.

Now in accordance with a feature of the invention, the bearing surface 25 of the rocker arm 20 is formed with a suitable predetermined radius R, while the bearing surface 41 of fulcrum 40 is formed with substantially a radius $\frac{1}{2}$ R, so that during pivotal movement of the rocker arm 20, the bearing surface 41 of fulcrum 40 will be in rolling contact with the bearing surface 25 of rocker arm 20. The relative rolling contact between these bearing surfaces having a radii ratio of 2:1 may be referred to as cardanic motion. Cardanic motion is the plane motion of a circle or cylinder rolling inside another circle or cylinder, respectively, twice its size without slippage at the contact point between these elements. Thus in the embodiment of the rocker arm and fulcrum shown, the cardanic motion is obtained by having the radii of curvature of these fixed and moving centrodes in the ratio of 2:1, with the centrodes lying on the same side of a common tangent. With this ratio of the radii of 2:1 to obtain cardanic motion, a point on the circumference of the rolling circle or cylinder will be in a straight line extending through the axis of the rolling circle or cylinder.

In addition, the fulcrum 40, as best seen in FIGS. 1 and 2, is provided with a raised retainer pin 44 depending from and preferably located intermediate the ends of the bearing surface 41. The retainer pin 44 thus extends longitudinally outward a predetermined distance from opposite sides of the aperture 43 and in alignment with and at right angles to the axis of this vertical aperture 43. Thus, preferably, the retainer pin is symmetrically located with respect to the axis of stud 50. The raised retainer pin 44 which is shaped similar to a gear tooth and is of suitable thickness to withstand any side loading thereon to be encountered in a given engine application, is slidably received in a through tapered recess or guide slot 29 provided in the intermediate portion 24 of the rocker arm 20.

As best seen in FIGS. 1 and 3, guide slot 29 is also preferably located intermediate the ends of the bearing surface 25 so as to extend transversely outboard of the aperture 28 in alignment with and at right angles to the central vertical axis of this aperture.

The width of guide slot 29 is preselected relative to the width of pin retainer 44, whereby the retainer pin 44 will be slidably received in the slot 29 so that it will be operative to insure the rolling contact of bearing surface 41 relative to the bearing surface 25 of the rocker arm 20. It will also be apparent that this retainer pin 44 and guide slot 29 arrangement will be operative so as to prevent lateral pivotal movement of the rocker arm at right angles to its plane of intended pivotal movement in response to reciprocation of the push rod 16. A preferred guide slot 29 and cooperating retainer pin 44 configuration is described in detail hereinafter.

The salient features of the subject rolling contact rocker and arm pivot can be stated as follows:

Rolling contact is secured by a combination of (i) curved bearing surfaces 25 and 41 in rolling contact relative to each other and (ii) rolling contact maintained to a significant degree by guiding a pin 44 on the fulcrum 40 extending into a tapered, vertical slot 29, in the rocker arm 20, the pin center coinciding with the point of contact of these curved bearing surfaces in the mean position of the rocker arm 20, the position shown in FIG. 1.

The pin-in-slot guidance utilizes the cuspidal nature of the path of the point of contact of the bearing surfaces 25 and 41 of the rocker arm and fulcrum to minimize clearance and length of the slot.

Figure 4:
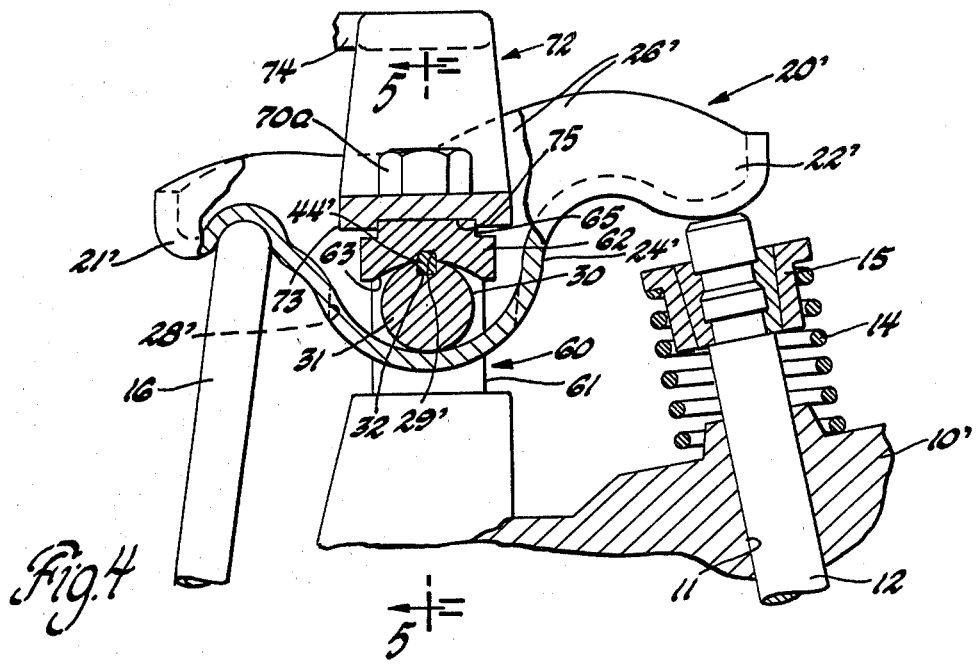
FIG. 4 is a cross-sectional view of a portion of an engine having a rocker arm and fulcrum in accordance with a second embodiment of the invention being incorporated therein, the rocker arm having parts thereof broken away and being shown in its mean position.
Figure 5:
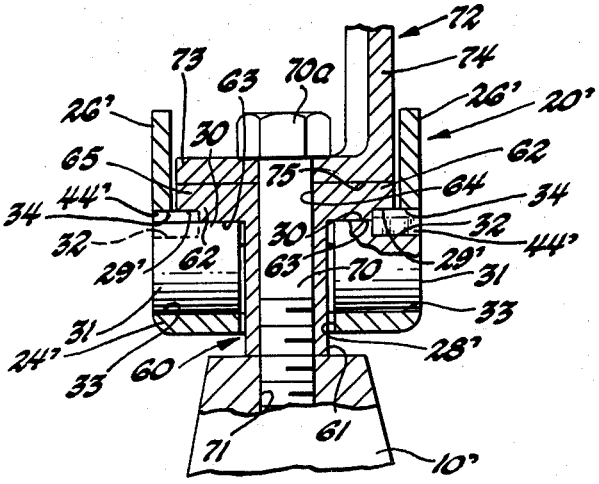
FIG. 5 is a transverse cross-sectional view of the assembly of FIG. 4 taken along line 5—5 of FIG. 4.
Figure 6:
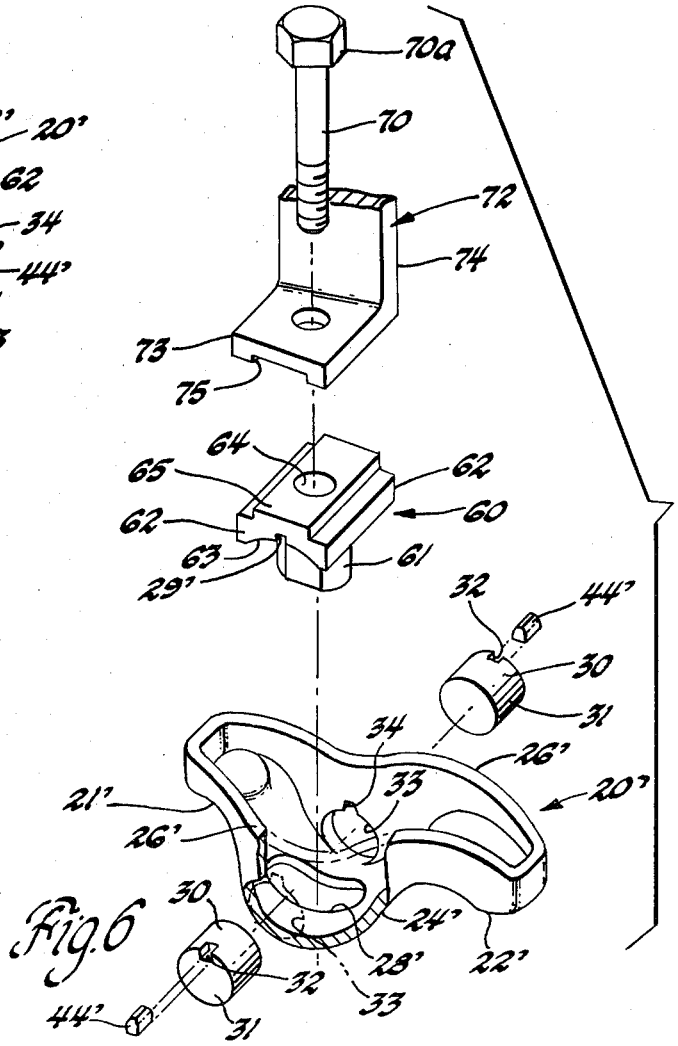
FIG. 6 is an exploded perspective view of the assembly of FIG. 4.

An alternate embodiment of a rocker arm and fulcrum structure in accordance with the invention is shown in FIGS. 4, 5 and 6, wherein similar parts are designated by similar numerals but with the addition of a prime (') where appropriate.

Rocker arm 20', in this alternate embodiment, is also provided with arms 21' and 22' and an intermediate portion 24'. As shown in FIGS. 4, 5 and 6, the rocker arm is substantially U-shaped in a transverse cross-section with a web portion defined by the arms 21' and 22' and the intermediate portion 24' and with integral upstanding side walls 26'.

The web portion of rocker arm 20', intermediate its ends and centrally of the intermediate portion 24', is provided with a longitudinally extending through aperture 28'. On opposite transverse sides of the aperture 28', the rocker arm 20' is provided with a transversely extending rocker means which define semi-cylindrical bearing surface means 30. In addition, the semi-cylindrical bearing means 30 have a retainer pin means 44' extending radially outward therefrom intermediate its arcuate ends.

In the construction illustrated in FIGS. 4, 5 and 6, the rocker means are defined by a pair of transversely spaced apart rocker pins 31 formed as separate elements which are suitably secured to the rocker arm 20', with each rocker pin 31 having a retainer pin 44', also formed as separate elements, suitably fixed thereto. For the latter purpose, in the construction illustrated, each rocker pin 31' is provided with an axially extending slot 32 in the outer peripheral surface thereof and extending a predetermined extent from one end thereof of a configuration so as to receive the foot end of a retainer pin 44' which is then fixed, as by welding to the rocker pin.

Again with reference to the construction shown, each side wall 26' is provided with a key-shaped aperture therethrough that is aligned with and formed at right angles to the axis of the aperture 28' and which defines a semi-circular aperture 33 of a size to slidably receive an associate rocker pin 31 and a slot aperture 34 of a size and shape to receive the exposed portion of the associate retainer pin 44'.

As best seen in FIGS. 5 and 6, each rocker pin 31 and associate retainer pin 44' is inserted into an associate side wall 26' so that the retainer pin 44' is located at the outboard end of its rocker pin 31 as thus partly trapped within the associate side wall 26'. The rocker pin 31 and associate retainer pin 44' can then be further fixed to the rocker arm 20', for example, as by welding at the interface of these elements with the associate side wall 26'.

Associated with the rocker arm, is a fulcrum post 60, of T-shaped configuration, as best seen in FIGS. 5 and 6, having a vertical extending post 61 portion with fulcrum arms 62 extending outward from opposite sides thereof and at right angles thereto, the combined extent of which is such that these fulcrum arms will be slidably received between the side walls 26' of the rocker arm 20'. Also as shown, the post 61 is suitably sized so that it can loosely extend through the aperture 28' in rocker arm 20'.

Each fulcrum arm 62 on its lower face is provided with a concave, semi-cylindrical bearing surface 63 for relative rolling engagement with the bearing surface means 30 of rocker pins 31. In addition, each fulcrum arm 62 at its outboard or free end is provided with a tapered guide slot 29' of a suitable size and shape to slidably receive the retainer pin 44' on an associate rocker pin 31.

A central aperture 64 extends through the fulcrum post 60 whereby it can be suitably secured, as by a screw 70 threaded into a suitably internally threaded aperture 71 provided for this purpose in the cylinder head 10'.

Now in order to insure against rotation of the fulcrum post 60 and the rocker arm 20' about the axis of the screw 70 and since normally a second rocker arm and associate fulcrum post, not shown, are located in spaced, substantially side-by-side relationship with each other, a retention member 72 is used with these assemblies in a manner similar to that disclosed in U.S. Pat. No. 3,198,183, entitled Stud Type Rocker Arm Mounting issued Aug. 3, 1965 to Frank W. Ball.

In the construction shown in FIGS. 4, 5 and 6, the retention member 72 is formed so as to extend between an adjacent pair of screws 70, only one being shown, and has spaced apart apertured base portions 73 and an inverted U-shaped interconnecting web 74. Each base portion 73 is adapted to receive an associate screw 70 so as to underlie the head **70*a* of the screw and to be clamped thereby against an associate fulcrum post 60. Each base portion 73 on its lower face is provided with a slot recess 75 and each fulcrum post 60 at its upper end is provided with a complimentary upstanding boss 65 engaged in the associate slot recess 75. Thus the retention member 72 cooperates with an adjacent pair of screws 70 and the associate fulcrum posts in mutually retaining the latter from rotating about the screws 70**.

In this alternate embodiment of FIGS. 4, 5 and 6 the ratio of the radius of the bearing surfaces 63 of the fulcrum arms to the radius of the bearing surface means 30 of the rocker pins 31 is preferably 2:1.

Based on calculations, it was originally estimated that an improvement in fuel economy of 1½% to 2% could be obtained in an internal combustion engine if the friction losses in the valve train due to the normal sliding contact between the rocker arm and its associate pivot could be substantially eliminated. However, in an initial test of a V-6 engine using a prototype embodiment of rocker arm and pivot assemblies similar to that of FIGS. 4, 5 and 6, constructed in accordance with the invention, resulted in an actual 2.1% improvement in the fuel economy of this engine as compared to the operation of the same engine with conventional rocker arm and pivot assemblies.

The rolling contact between the rocker arm and pivot assembly thus far described hereinabove provides substantially the same low friction as a rolling bearing, but acclmplishes this with a simple and low cost construction. The subject rolling contact rocker arm and pivot arrangement, except for their respective bearing surfaces and the associate retainer pin and slot arrangement shown, are substantially similar in general appearance to conventional production type rocker arms and pivots. It should thus be apparent that rocker arm and pivot structures in accordance with the invention can be easily substituted for these prior art rocker arms and pivots in the valve trains of production engines or in previously produced engines, because such substitutions can be readily made without any substantial modification to such engines.

The rolling contact between the rocker arm and pivot of the subject invention is comparable to that of a cylinder rolling in a conforming cylinder. Such conforming contact of one cylinder in rolling contact within another cylinder creates a substantially lower operating contact stress than that which occurs with a cylinder rolling on a flat or substantially flat surface. For example, from standard engineering formulas it can be shown that a cylinder rolling on a flat surface will create a higher operating contact stress substantially greater than that which occurs in conforming contact such as that of the subject rocker arm and fulcrum. Thus normal gage conventional materials, as presently used in production rocker arms, can be used to fabricate rocker arms constructed in accordance with the invention.

Although cardanic motion is obtained by having the radii of the bearing surface formed in the ratio R:½R or 2:1, which is the preferred configuration, it will be apparent to those skilled in the art that this ratio may be varied, if desired within predetermined limits. Thus, for example, if the rocker arm need only move through a relatively small angular displacement to effect the desired valve opening movement in a particular engine application, it may then be possible to obtain substantial rolling contact performance which closely approximates cardanic motion with circle radii ratios other than 2:1. For example, the ratio of these cooperating radii could be reduced down to 1.7:1 or increased above 2:1 to, for example, the ratio of 3:1 with favorable results.

However, it should be realized that as the ratio of these radii varies from the ratio of 2:1 the stress lead on the rocker arm will be increased accordingly. It should therefore be apparent to those skilled in the art that as long as the angular displacement of the rocker arm is acceptably small, the minor deviation from cardanic rolling motion may be acceptable in a given engine application.

Because of the various forces acting on the rocker arm during engine operation and, in particular, the side thrust forces imparted to the rocker arm as by its frictional engagement with an associate poppet valve 12, it has been found that for stable rocker arm operation, the guide slot 29 and associate alignment pin should be constructed so as to substantially reduce or entirely eliminate sliding motion between the rocker arm and its associate fulcrum due to such forces.

For this purpose, the guide slot 29 or 29' is of tapered, outwardly flared, configuration with a preselected apex angle 2 $\psi$, as desired, and is preferably formed with each of the inclined opposed walls defining the slot being of straight surface configuration, since such flat surfaces are more economical to make than hypocycloidic guide surfaces.

Preferably, for a preselected apex angle of the guide slot 29 or 29', the associate alignment pin 44 or 44' is then specifically profiled for a given ratio of the radii of the bearing surfaces of the rocker arm and fulcrum, respectively, in such fashion that the envelope or path of the laterally most extended points of pin as it translates and rotates is substantially the shape of the slot and the pin walks or rolls on the slot during rocker arm reciprocation.

Referring now to FIGS. 7, 8, 9 and 10, the desired pin profile for a given ratio of the radii of the bearing surfaces 25 or 63 and 41 or 30, with the rocker arm pivoting through a preselected angle $\theta$ max. for a given engine application, can be determined, as desired, either analytically or graphically in a manner to be described in detail hereinafter. The embodiment of the rocker arm and pivot assembly of FIGS. 1–3 is used for the purposes of the following description, with the pertinent portions of the rocker arm 20 and fulcrum 40, with reference to this embodiment being schemically illustrated in their inverted positions. Basically the elements are thus illustrated to show, in effect, a small cylinder, i.e., the fulcrum bearing surface 44, rolling inside an outer cylinder, i.e., the bearing surface 25 of rocker arm 20, to facilitate visualization of the motions that occur when there is relative rolling contact between these elements. Of course it should be realized that with reference to the embodiment of FIGS. 4–6, the small cylinder would be the bearing surface means 30 of the rocker pins 31 and the outer cylinder would then be the bearing surfaces 63 on the fulcrum arms 62.

To design the retainer pin profile, it is necessary first to determine the angle of roll, $\theta$ max, of the rocker arm 20 in opening the poppet valve 12 to its maximum lift for a particular engine application. The location of the tapered guide slot 29 on the rocker arm 20 also has to be defined. Preferably and as illustrated, the guide slot 29 is symmetrically located with respect to the axis of stud 50. Accordingly, the retainer pin 44 is also thus symmetrically located with respect to the stud axis.

Figure 7:
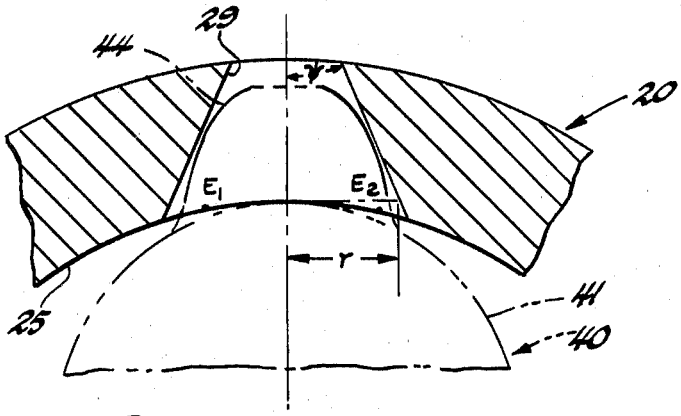
FIG. 7 is an inverted, enlarged graphic view of a preferred embodiment of a tapered guide and retainer pin, per se, for use in a rocker arm and fulcrum constructed in accordance with the invention, the guide and retainer pin being shown in the mean position relative to each other.
Figure 8:
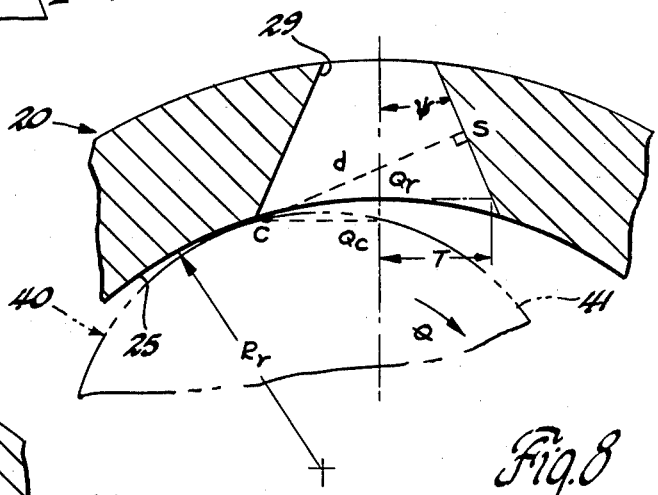
FIG. 8 is an inverted, enlarged graphic view showing how the retainer pin profile of FIG. 4 can be determined analytically.

As best seen in FIGS. 7 and 8, the width and therefore the half-width $\tau$ of the tapered guide slot 29, next adjacent to the bearing surface 25, is preselected so as to enable the retainer pin 44 to be of a suitable thickness to obtain the desired structural strength of the retainer pin for a given engine application. In addition, the width and therefore the half-width $\tau$ should also be large enough to extend beyond the extreme points of contact $E_1$ and $E_2$ between the rocker arm and fulcrum during predetermined pivotal movement of the rocker arm relative to the fulcrum, as shown in FIG. 4.

Figure 9:
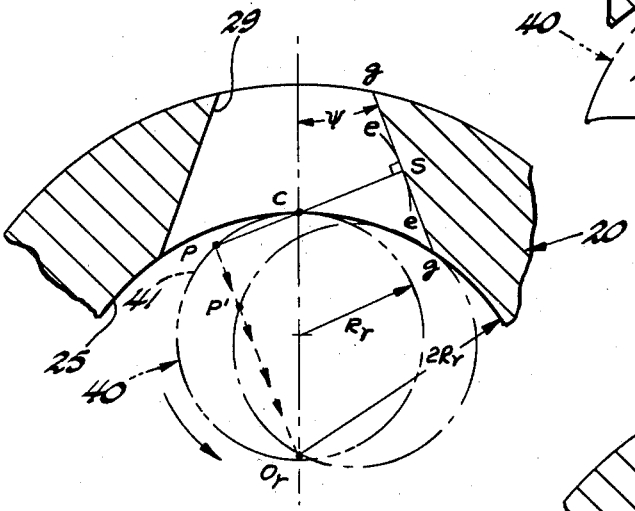
FIGS. 9 and 10 are inverted, enlarged graphic views showing how the retaining pin profile can be determined graphically when the ratio of the radii for the rocker arm and fulcrum is substantially 2:1; and, FIG. 11 is an enlarged fragmentary cross-sectional view of a portion of a rocker arm and associate fulcrum showing the guide slot and retainer pin thereof for the rocker arm and fulcrum of FIGS. 1–3, with the ratio of the radii of the bearing surfaces thereof being substantially 2:1.

In practice, the apex angle of the tapered slot 29, and therefore the semi-apex angle $\psi$ of this slot, with reference to FIGS. 7–9 in addition to the above parameters should be preselected so as to reduce relative sliding of the retainer pin 44 on the guide surfaces defining guide slot 29 as well as to facilitate the manufacturing of this tapered guide slot. For this latter purpose and again with reference to the embodiment of FIGS. 1–3, the apex angle is preferably selected relative to the thickness of the curved portion 24 of the rocker arm 20 so that this guide slot is formed as a through slot.

As shown in FIG. 8, the basic principle for calculating the retainer pin profile depends on the fact that the line joining the point of contact C between the bearing surfaces with the point of restraint S on the opposed side surface of the guide slot 29 should be perpendicular to that guide surface, as illustrated. The point of rolling contact C on the rocker arm 20 is the instantaneous center of rotation of the fulcrum 40 (rolling cylinder) and since point S on the retainer pin 44 is part of fulcrum 40 (rolling cylinder), the instantaneous velocity of point S has to be perpendicular to the line CS.

The desired retainer pin profile can then be calculated analytically in the following manner with reference to FIG. 8 and the basic principle described hereinabove.

Now let it be assumed that the rocker arm 20 is fixed while the fulcrum bearing surface 41 of the fulcrum 40, i.e., the rolling cylinder rolls on it. Again, start with the fulcrum or rolling cylinder in the symmetrical position where at this same position the rocker arm has, in effect, rotated an angle $\theta_{max}/2$ from the full valve closure position.

In this symmetrical position, let $Q_r$ be the point of contact on the surface 25 of rocker arm 20 and $Q_c$ be that same point but on the surface 41 of the fulcrum 40. These two points therefore move apart when the fulcrum or rolling cylinder starts to roll. The fulcrum or rolling cylinder is then rolled clockwise through an angle $\theta$. It will then be seen that the point of contact on the rocker arm will have moved to a point C. It is then necessary to locate the point of restraint S between the retainer pin and the wall of the guide slot by dropping a perpendicular from C to the right-hand side of the tapered guide, with reference to FIG. 8. The point S is also a point on the retainer pin profile for the given rotated position. The distance or length d from a point of contact C along a line perpendicular to the opposed surface of the guide slot 29, that is to a point S, varies in accordance with the amount of rolling or walking motion.

Accordingly, the entire retainer pin profile may then be obtained by calculating d, the distance CS, as a function of the rotation $\theta$. This can readily be shown to be:

$$d = \left\{ NR_r \left[ \sin \frac{\theta}{N-1} + \left(1 - \cos \frac{\theta}{N-1}\right) \tan \psi \right] + \tau \right\} \cos \psi$$

where d=length CS;

N=radii ratio of restrainer to rolling cylinder (>1);

$R_r$=radius of curvature of rolling cylinder;

$\psi$=semi-apex angle of guide;

$\tau$=half width of tapered guide. See FIGS. 7 and 8.

By substituting the various values of the degrees of angle $\theta$ from 0 to $\theta_{max}/2$, for example, in 10 minute increments, the various values for d, the length CS, can be calculated to obtain the desired working profile for the right hand side of the retainer pin 44, with reference to FIG. 7, for example. Thus if the rocker arm oscillates through an arc $\theta$ max of 16°, for example, then $\theta_{max}/2$ would be 8° and, using the above 10 minute increments, a sufficient number of points on the profile of the retainer pin can then be calculated to provide the required working profile thereof. Of course the left hand profile of the retainer will be of similar but of opposed configuration.

Again referring to FIG. 7, the crest of the retainer pin connecting the opposed working profiles or working surface of the retainer pin can be selected, as desired. In a similar manner the fillet profiles connecting the working surfaces of the retainer pin 44 to the bearing surface 41 of the fulcrum can also be selected, as desired.

It should now be apparent to those skilled in the art, that the above equation for the retainer pin profile could be rewritten in polar coordinates in a known manner.

The equation discussed hereinabove for the design of the retainer pin profile are good for a general N ranging, preferably as noted hereinabove, from 3 to 1.7. However, there exist special characteristics that for N=2, as in the preferred embodiment, that is, for cardanic motion, the profile is immensely simplified. Moreover as will be described herein, these same characteristics make the profile synthesis direct without any need for either numerical computation nor tedious graphical tracing.

As previously described, for a ratio of N=2, the rolling cylinder has a rolling motion called cardanic motion. It can thus be shown, as illustrated in FIG. 9, that any point P, on the circumference of the fulcrum 40 or rolling cylinder, traces a straight line that passes through the center of curvature $O_r$ of the rocker arm 20 or outer cylinder. An explanation of how this motion characteristic helps in the design of the pin profile follows.

Referring again FIG. 9, from the point of contact C, a line is then drawn perpendicular to the surface of guide g—g intersecting the latter at S, and the rolling cylinder at P. As explained in the previous paragraph, when the rolling cylinder rolls, as in a counterclockwise direction with reference to this Figure on the rocker arm 20, point P travels in a straight line passing through point $O_r$, the center of curvature of the bearing surface 25 of the rocker arm.

Now, from elementary geometry, $<CPO_r$ is 90 degrees and PS is perpendicular to g—g. Therefore, the line of travel of point P along $PO_r$ is parallel to the straight guide g—g.

Suppose the pin, which is attached to the rolling cylinder or fulcrum 40, has a radius of curvature equal to length PS, with P as the center of curvature. Then, as can be seen from FIG. 9, P travels along PP' parallel to guide g—g so that the pin is always in contact with the guide. At the point of restraint between the pin and the guide a combination of rolling and some sliding occurs. Since the active arc e—e of the pin profile is circular, it is therefore easy to design. The radius of curvature of the pin can be shown to be:

$$\rho = 2R_r \sin \psi + \tau \cos \psi$$

For various reasons, such as sudden shocks on the engine or pushrod out-of-planeness, it is desirable to design the pin profile such that there are two contact points between the pin and its guide, one point of restraint on each side of the pin. Such two-point restraint, as can be obtained in the preferred embodiment as when the ratio of the radii is substantially 2:1, will insure that the rocker arm is constrained to roll through its entire motion. To achieve such a design, the extremal points of contact of the rolling cylinder on the restrainer must lie within the width $2\tau$ of the tapered guide, as previously described hereinabove.

The following is a stepwise procedure for designing such a pin profile given N=2.

1. Set the rolling cylinder on the line of symmetry of the tapered guide. At this position, make sure that the rocker arm has rolled through an angle of $74_{max}/2$ from the position of full valve closure. With this initial geometry the extremal points of contact on the restrainer are equidistant from the said line of symmetry but on opposite sides of it. It is then necessary to determine that these extremal points of contact are within the width of the tapered guide 29.

2. A line is then drawn from the point of contact C perpendicular to the straight surface of the right side, with reference to FIG. 9, of tapered guide g—g, intersecting the guide at the point S, and the rolling circle at point P.

3. Using point P as the center of curvature and distances PS as the radius, an arc of sufficient length to cover the entire active arc can be drawn so that it will be in contact with the guide.

4. The same procedure is carried out for the other side of the pin. Both of these arcs should be symmetrical about the tapered guide line of symmetry.

Figure 10:
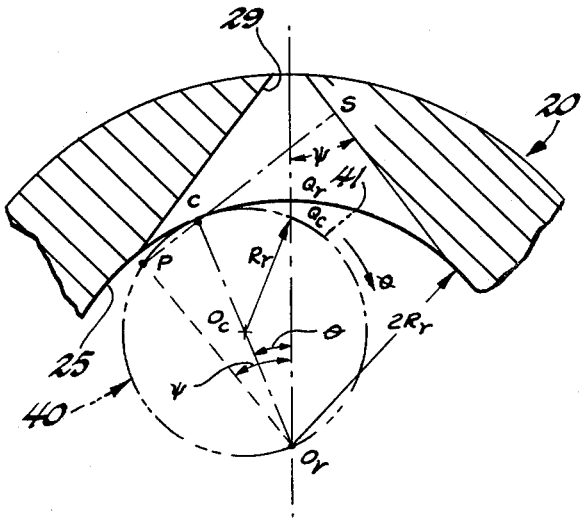

Referring now to FIG. 10, there is illustrated the geometry of the rolling cylinder, where N=2, after it has rolled an angle $\theta$ from its position of symmetry. Then, $$<CO_rQ_c=\theta.$$

Note that by applying the cardanic principle, points $Q_r$, $Q_c$ and $O_r$ are collinear. Therefore, since $PO_r$ is parallel to the straight guide, $$<PO_rQ_c=\psi$$

so that $$<PO_rC=\psi-\theta;\ \psi>\theta$$

Distance PC is given by:

$$PC=2R_r \sin(\psi-\theta)$$

since $O_rC$ is equal to $2R_r$ and angle $CPO_r$ is a right angle. From equation previously described, $$PS=2R_r \sin\psi+\tau\cos\psi$$

Therefore $$\begin{aligned} CS &= PS - PC \\ &= 2R_r \sin\psi - 2R_r\sin(\psi-\theta) + \tau\cos\psi \\ &= 2R_r \sin\psi + 2R_r\sin(\theta-\psi) + \tau\cos\psi \end{aligned}$$

It will be seen that the above equation is the same as that obtained by substituting N=2 into the previously defined equation for finding d showing that this circular profile is obtained only if the curvature ratio is equal to 2, that is, the ratio of the radii is 2:1, and wherein $\psi$ is greater than $\theta_{max}/2$.

Thus when the ratio of the radii is substantially 2:1, the profiled working surfaces of the retainer pin 44 are of semi-circular profile whereby rolling motion is obtained of these surfaces on the flat guide surfaces provided by the guide slot 29. In addition with this arrangement, substantially no slipping of either the retainer pin 44 or the rocker arm can occur because of the two point restraint imposed on the alignment pin 44 by the tapered flat surfaces defining the guide slot 29.

Figure 11:
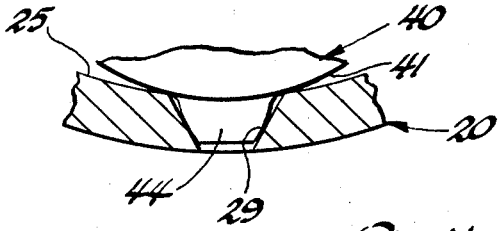

Referring now to FIG. 11 there is illustrated an embodiment of a preferred guide slot 29 and retainer pin 44 configuration for the rocker arm and fulcrum structure, of the type shown in FIGS. 1–3, for use in a particular engine. In this particular application the fulcrum bearing surface 41 of the fulcrum 40 is provided with a 6 mm radius of curvature while the bearing surface 25 of the rocker arm 20 is provided with a 12 mm radius of curvature. Thus the ratio of the radii of these bearing surfaces are 2:1.

In this particular application, $\theta max=17°-30'$ and therefore $\theta_{max}/2=8°-45'$. The apex angle of the guide slot 29 was 50° and, accordingly, the semi-apex angle of the guide $\psi=25°$. The radius $R_r$ of curvature of the rolling cylinder, that is, of the fulcrum bearing surface is 6 mm and the half width of the tapered guide slot $\tau$=approximately 3.75 mm to permit the retainer pin 44 to have a width of approximately 6.6 mm. The radius of curvature P of the retainer pin 44 in this embodiment was 7.87 mm at two places to provide for the right and left hand semi-circular working profiles of the pin and the pin height was approximately 3 mm. With this configuration of the retainer pin 44, it will have each of the working profiles thereof in contact with an associate surface of the opposed inclined surfaces defining the guide slot 29.

The embodiments of the invention in which an exclusive property or privilege is claimed are defined as follows:

1. A reciprocating internal combustion engine of the type having an engine block defining a cylinder with a port, a valve reciprocably located in said port and biased to a predetermined position, a valve actuator spaced from the valve and movable in opposite sense to reciprocate the same, and a valve train means including a rocker arm in engagement with the valve and the valve actuator and actuated in rocking movement to reciprocate said valve against said bias to open and close the port for engine operation, the improvement comprising:

means defining a rocking support intermediate the length of the rocker arm, said means and said rocker arm defining a pair of cooperating inner and outer cylindrical bearing surface contours carrying the reaction forces of rocker arm pivotal movement, the radius of the outer conformation being in the range of about 3 to 1.7 times the radius of the inner conformation;

restrainer means to anchor the cooperating cylindrical conformations for substantially rolling action in relation to each other, said restrainer means comprising a pin extending radially outward from the inner conformation and a recess in the outer conformation of a size to receive said pin, said recess defining opposed sloping guide surfaces flaring outward in the direction toward the center of the outer conformation and over which the pin walks during rocker arm oscillation, the conformation of the pin being such that the pin moves in substantially walking motion during such reciprocation, whereby within the range of rocker arm oscillation the pin establishes substantially rolling contact between the cylindrical surfaces by contact with the guide surfaces of the recess and itself executes substantially rolling contact with the guide surfaces defined by the recess.

2. A reciprocating internal combustion engine of the type having an engine block defining a cylinder with a port, a valve reciprocably located in said port and biased to a predetermined position, a valve actuator spaced from the valve and movable in opposite sense to reciprocate the same, and a valve train means including a rocker arm in engagement with the valve and the valve actuator and actuated in rocking movement to reciprocate said valve against said bias to open and close the port for engine operation, the improvement comprising:

means defining a rocking support intermediate the length of the rocker arm, said means and said rocker arm defining a pair of cooperating inner and outer cylindrical surface contours carrying the reaction forces of rocker arm pivotal movement, the radius of the outer conformation being in the range of substantially two times the radius of the inner conformation;

restrainer means to anchor the cooperating cylindrical conformations for substantially rolling action in relation to each other, said restrainer means comprising a pin extending radially outward from the inner conformation and into a recess in the outer conformation, said recess defining opposed sloping guide surfaces flaring outward in the direction toward the center of the outer conformation and over which the pin engages during rocker arm oscillation, the working surfaces of the pin being of semi-circular profile such that the pin moves in substantially walking motion during such reciprocation in substantial two-point contact with the opposed sloping guide surfaces, whereby within the range of rocker arm oscillation the pin establishes substantially rolling contact between the cylindrical surfaces by contact within the recess and itself executes substantially rolling contact with the guide surfaces defined by said recess.

3. In a valve train for an internal combustion engine of the type having a cylinder block means defining at least one cylinder with a port, a valve reciprocably mounted for controlling flow through the port, a rocker arm having one end thereof operatively associated with the valve, a fulcrum operatively associated with the rocker arm intermediate the ends thereof, a retainer means fixed to said cylinder block means and having a portion thereof extending through both the rocker arm and the fulcrum for holding these elements in operative engagement with each other and, an actuating means operatively associated with the rocker arm to effect rocking motion thereof to reciprocate said valve, the improvement wherein: said fulcrum defines a convex, semi-cylindrical fulcrum bearing surface, said fulcrum further including a retainer pin extending radially outward from said fulcrum bearing surface intermediate the ends thereof; and wherein, said rocker arm includes means defining a concave, semi-cylindrical bearing surface, said rocker arm further including a guide recess in said bearing surface of a size to operatively receive said retainer pin and defining a pair of opposed sloping guide surfaces for operative engagement by said retainer pin; the radius of said bearing surface being in the range of about 1.7 to 3 times the radius of said fulcrum bearing surface, whereby during oscillation of said rocker arm said retainer pin maintains substantially rolling contact between said bearing surfaces by engagement within said guide recess and in turn executes substantially rolling contact with the guide surfaces defined by said guide recess.

4. In a valve train for an internal combustion engine of the type having a cylinder block means defining at least one cylinder with a port, a valve reciprocably mounted for controlling flow through the port, a rocker arm having one end thereof operatively associated with the valve, a fulcrum operatively associated with the rocker arm intermediate the ends thereof, a retainer means fixed to said cylinder block means and having a portion thereof extending through both the rocker arm and the fulcrum for holding these elements in operative engagement with each other and, an actuating means operatively associated with the rocker arm to effect rocking motion thereof to reciprocate said valve, the improvement wherein: said fulcrum defines a convex, semi-cylindrical fulcrum bearing surface of a radius R, said fulcrum further including a retainer pin extending from said fulcrum bearing surface intermediate the ends thereof, said retainer pin having opposed semi-cylindrical working surfaces; and, wherein, said rocker arm includes means defining a concave, semi-cylindrical bearing surface of substantially a radius 2R, said rocker arm further including a guide recess in said bearing surface of a size to operatively receive said retainer pin and defining a pair of opposed sloping guide surfaces for operative engagement by said retainer pin, whereby during oscillation of said rocker arm said retainer pin maintains substantially rolling contact between said bearing surface and said fulcrum bearing surface by engagement with said guide surfaces and in turn has the working surfaces thereof in substantially rolling contact with the guide surfaces defined by said guide recess.

5. In an internal combustion engine of the type having a cylinder block with a valve reciprocably mounted therein and having a rocker arm operatively associated with the valve, a fulcrum means operatively associated with the rocker arm and, a retainer means fixed to the cylinder head and having a portion thereof extending through both the rocker arm and the fulcrum means for holding these elements in operative engagement with each other the improvement wherein: said rocker arm includes a pair of spaced apart side flanges extending upward from opposite longitudinal sides of a base having an aperture extending therethrough, said aperture being located intermediate the ends of said base and being sized so as to operatively receive the retainer means and, a pair of fixed opposed rocker members defining semi-cylindrical bearing surfaces extending transversely between said flanges toward said aperture, said bearing surfaces having a retainer pin means extending radially outward therefrom intermediate its ends; and, wherein said fulcrum means includes a semi-cylindrical fulcrum surface of a substantially uniform radius engaging said bearing surfaces of said rocker members, said fulcrum means further including a guide slot means defining opposed sloping guide surfaces which extend in a direction parallel to the axis of said fulcrum surface intermediate the ends thereof so as to operatively receive said retainer pin means, the radius of said fulcrum surface being in the range of about 3 to 1.7 times the radius of said bearing surfaces, whereby within the range of rocker arm oscillation said retainer pin means establishes substantially rolling contact between the bearing surfaces and said fulcrum surface by its contact with the guide surfaces with said retainer pin means being in substantially rolling contact with said guide surfaces.

6. In an internal combustion engine of the type having a cylinder block with a valve reciprocably mounted therein and having a rocker arm operatively associated with the valve, a fulcrum means operatively associated with the rocker arm and, a retainer means fixed to the cylinder head and having a portion thereof extending through both the rocker arm and the fulcrum means for holding these elements in operative engagement with each other the improvement wherein: said rocker arm includes a pair of spaced apart side flanges extending upward from opposite longitudinal sides of a base having an aperture extending therethrough located intermediate its ends and sized so as to operatively receive the retainer means and a pair of fixed opposed rocker members defining semi-cylindrical bearing surfaces extending transversely between said flanges toward said aperture, said bearing surfaces having a retainer pin means extending upward therefrom intermediate its ends, and wherein said fulcrum means includes a semi-cylindrical fulcrum surface of a substantially uniform radius engaging said bearing surfaces of said rocker members, said fulcrum means further including a guide slot means defining opposed sloping guide surfaces which extend in a direction parallel to the axis of said fulcrum surface intermediate the ends thereof so as to operatively receive said retainer pin means, the radius of said fulcrum surface means being substantially two times the radius of said bearing surfaces and the opposed working surfaces of said retainer pin means being of semi-cylindrical profile, whereby within the range of rocker arm oscillation said retainer pin means establishes substantially rolling contact between the bearing surfaces and said fulcrum surface by its contact with the guide surfaces with said retainer pin means being in substantially rolling contact with the guide surfaces defined by said guide slot means.

7. A reciprocating internal combustion engine of the type having an engine block defining a cylinder with a port, a valve reciprocably located in said port and biased to a predetermined position, a valve actuator spaced from the valve and movable in opposite sense to reciprocate the same, and a valve train means including a rocker arm in engagement with the valve and the valve actuator and actuated in rocking movement to reciprocate said valve against said bias to open and close the port for engine operation, the improvement comprising:

means defining a rocking support intermediate the length of the rocker arm, said means and said rocker arm defining a pair of cooperating inner and outer bearing surfaces of semi-cylindrical configuration carrying the reaction forces of rocker arm pivotal movement, the radius of the outer bearing surface being in the range of about 3 to 1.7 times the radius of the inner bearing surface;

restrainer means to anchor the cooperating cylindrical bearing surfaces for substantially rolling action in relation to each other, said restrainer means comprising a pin extending radially outward from the inner bearing surface and a recess in the outer bearing surface of a size to receive said pin, said recess defining opposed sloping guide surfaces of such degree of flare as to define substantially the envelope of the laterally most extended points of rolling contact between said bearing surfaces during rocker arm oscillation, the pin having opposed convex working surfaces of a profile so that said pin remains in said recess with the working surfaces thereof in substantially rolling engagement with said guide surfaces during said oscillation.

8. A reciprocating internal combustion engine of the type having an engine block defining a cylinder with a port, a valve reciprocably located in said port and biased to a predetermined position, a valve actuator spaced from the valve and movable in opposite sense to reciprocate the same, and a valve train means including a rocker arm in engagement with the valve and the valve actuator and actuated in rocking movement to reciprocate said valve against said bias to open and close the port for engine operation, the improvement comprising:

means defining a rocking support intermediate the length of the rocker arm, said means and said rocker arm defining a pair of cooperating inner and outer bearing surfaces of semi-cylindrical configuration carrying the reaction forces of rocker arm pivotal movement, the radius of the outer bearing surface being in the range of about 3 to 1.7 times the radius of the inner bearing surface;

restrainer means to anchor the cooperating cylindrical bearing surfaces for substantially rolling action in relation to each other, said restrainer means comprising a pin extending radially outward from the inner bearing surface and a recess in the outer bearing surface of a size to receive said pin, said recess defining opposed sloping guide surfaces of such degree of flare as to define substantially the envelope of the laterally most extended points of rolling contact between said bearing surfaces during rocker arm oscillation, the pin having opposed working surfaces located symmetrical about a line of symmetry passing through the center of curvature of said inner bearing surface and each working surface consisting of circular arcs whose centers of curvature lie on the contact points of said inner bearing surface with said outer bearing surface on the opposite side of said line of symmetry during rolling engagement between said bearing surfaces.

9. A reciprocating internal combustion engine of the type having an engine block defining a cylinder with a port, a valve reciprocably located in said port and biased to a predetermined position, a valve actuator spaced from the valve and movable in opposite sense to reciprocate the same, and a valve train means including a rocker arm in engagement with the valve and the valve actuator and actuated in rocking movement to reciprocate said valve against said bias to open and close the port for engine operation, the improvement comprising:

means defining a rocking support intermediate the length of the rocker arm, said means and said rocker arm defining a pair of cooperating inner and outer cylindrical bearing surface contours carrying the reaction forces of rocker arm pivotal movement, the radius of the outer conformation being in the range of about 3 to 1.7 times the radius of the inner conformation;

restrainer means to anchor the cooperating cylindrical conformations for substantially rolling action in relation to each other, said restrainer means comprising a pin extending radially outward from the inner conformation and a recess in the outer conformation of a size to receive said pin, said recess defining opposed sloping guide surfaces flaring outward in the direction toward the center of the outer conformation and of such degree of flare as to define substantially the envelope of the laterally most extended contact points on the pin as its translation and rotation is traced so that the pin substantially walks over the guide surfaces during rocker arm oscillation, the conformation of the pin being such that each successive point of contact thereof on an associate guide surface falls on an imaginary line that extends for the point of contact between said bearing surface through said point which line is substantially perpendicular to that guide surface so that the pin moves in substantially walking motion during such reciprocation, whereby within the range of rocker arm oscillation the pin establishes substantially rolling contact between the cylindrical surfaces by contact with the guide surfaces of the recess and itself executes substantially rolling contact with the guide surfaces defined by the recess.

* * * * *